US010111804B2

(12) United States Patent
Qiao

(10) Patent No.: US 10,111,804 B2
(45) Date of Patent: Oct. 30, 2018

(54) DYNAMIC RECOVERY AND THERAPY SYSTEM

(71) Applicant: Wisdom Qiao, Brea, CA (US)

(72) Inventor: Wisdom Qiao, Brea, CA (US)

(73) Assignee: Amchi Gendynamy Science Corporation, Brea, CA (US)

( * ) Notice: Subject to any disclaimer, the term of this patent is extended or adjusted under 35 U.S.C. 154(b) by 551 days.

(21) Appl. No.: 14/861,908

(22) Filed: Sep. 22, 2015

(65) Prior Publication Data

US 2017/0079875 A1 Mar. 23, 2017

(51) Int. Cl.
*A61H 23/00* (2006.01)
*A61H 23/02* (2006.01)

(52) U.S. Cl.
CPC ..... *A61H 23/02* (2013.01); *A61H 2201/1623* (2013.01); *A61H 2201/1669* (2013.01); *A61H 2201/5002* (2013.01); *A61H 2205/081* (2013.01)

(58) Field of Classification Search
CPC ..... A61H 23/02; A61H 2205/081; A61H 2201/5002; A61H 2201/1623; A61H 2201/1669; A61H 2001/0233; A61H 2201/0134; A61H 2201/0157; A61H 2201/1664; A61H 2201/1666; A61H 2201/5005; A61H 2201/5007; A61H 2203/0468
See application file for complete search history.

(56) References Cited

U.S. PATENT DOCUMENTS

| | | | | |
|---|---|---|---|---|
| 6,375,630 | B1 | 4/2002 | Cutler et al. | |
| 6,551,450 | B1 * | 4/2003 | Thomas | A61H 9/0078 156/580.1 |
| 7,429,251 | B2 | 9/2008 | Tanizawa et al. | |
| 7,785,358 | B2 | 8/2010 | Lach | |
| 7,892,192 | B2 | 2/2011 | Tsukada et al. | |
| 8,469,454 | B2 | 6/2013 | Holt et al. | |
| 2003/0028132 | A1 | 2/2003 | Bastia et al. | |
| 2005/0124921 | A1 * | 6/2005 | Tseng | A61H 7/007 601/86 |

(Continued)

FOREIGN PATENT DOCUMENTS

| | | |
|---|---|---|
| DE | 102007051411 | 4/2009 |
| WO | 2012007860 | 1/2012 |

OTHER PUBLICATIONS

Jamie Condliffe, Massage Feels Good Because It Changes Your Gene Expression, Gizmodo, Feb. 6, 2012, 10 pages.

*Primary Examiner* — Quang D Thanh
(74) *Attorney, Agent, or Firm* — Fish IP Law, LLP

(57) ABSTRACT

Massage systems and methods for massaging a person's body include a massaging unit coupled to an processing module and a power supply. First and second actuators are housed in the first massaging unit. The first actuator applies a moving pressure to the person's body to create a first trace, and simultaneously, the second actuator applies a moving pressure to the person's body to create a second. The first trace includes a first segment of a perimeter of a rectangle from a first corner of the rectangle to a midpoint of a first edge that is adjacent to the first corner. The second trace includes a second segment of the perimeter of the rectangle from a second corner of the rectangle to a midpoint of a second edge that is adjacent to the second corner, and the first and second edges are parallel.

20 Claims, 6 Drawing Sheets

(56) References Cited

U.S. PATENT DOCUMENTS

2006/0217644 A1* 9/2006 Ozaki ..... A61H 9/0078
601/148
2013/0116852 A1* 5/2013 Dijk ..... A61H 23/02
700/301

* cited by examiner

(Left Side, 1st)

(Right Side, 1st)

(Left Side, 2nd)

(Right Side, 2nd)

(Left Side, 3rd)

(Right Side, 3rd)

(Left Side, 4th)

(Right Side, 4th)

Rectangular
Configuration of 18
Actuators in One
Massaging Unit

Rectangular Massaging
Module Having Nine
Massaging Units

Linear Configuration
of 18 Actuators in One
Massaging Unit

Linear Massaging
Module Having Nine
Massaging Units

Configuration of Massaging Devices on a Human's Back to the Left and Right of the Spine

DYNAMIC RECOVERY AND THERAPY SYSTEM

FIELD OF THE INVENTION

The field of the invention is massage devices and methods.

BACKGROUND

The following description includes information that may be useful in understanding the present invention. It is not an admission that any of the information provided herein is prior art or relevant to the presently claimed invention, or that any publication specifically or implicitly referenced is prior art.

Massages can be useful therapies for pain relief, to improve sleep, and are often incorporated into physical therapy regimens for the treatment of injuries. Because some people who would benefit from massages cannot afford a masseur/masseuse, efforts have been made to develop automated massaging devices to improve the accessibility of massages.

For example, U.S. Patent Publication No. 2003/0028132 to Bastia et al. discloses a massage pad with pockets in which massage actuators can be retained. This allows the actuators to be positioned to achieve different massage effects and to accommodate a wider range of user physiologies.

These and all other publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In another example, U.S. Pat. No. 7,429,251 to Tanizawa et al. discloses a massaging device programmed to use different massaging patterns to different parts of a user's body for enhanced and pleasant massaging effects.

Unfortunately, known massaging devices and methods fail to fully appreciate the wide range of health benefits (e.g., improving physical fitness, reducing blood pressure, reducing glucose levels, enhanced sleep, and potentially reduced or elimination of tumor growth) that could result from massages with predetermined patterns, pressures or frequencies.

Thus, there is still a need for improved massage devices and methods.

SUMMARY

The inventive subject matter provides devices and methods to reduce a person's blood pressure, blood glucose levels, pain, rate of tumor growth, and to enhance the person's sleep and physical fitness. In one aspect of the inventive subject matter, a massage system includes a massaging unit coupled to an processing module, and a power supply. The massaging unit houses first and second actuators. The first actuator applies pressure to a person's body in right, upward, left, and downward movements, and the second actuator simultaneously applies pressure in movements opposite to the direction of the first actuator. The first and second actuators could be configured to apply pressure to the person's body in a series of traces (e.g., 8 traces, 4 traces from each actuator) to form a perimeter of a rectangle. Additionally or alternatively, one or both actuators could be configured to apply pressure to the person's body in a clockwise or counter-clockwise direction to form a perimeter of an ellipsoid.

In some aspects where the first and second actuators are configured to apply pressure in a series of traces to form a perimeter of a rectangle, the first two traces could comprise the following: (a) the first actuator applies pressure to the person's body according to a first trace, wherein the first trace comprises tracing a first segment of the perimeter of the rectangle by moving from a first corner of the rectangle to the midpoint of a first edge that is adjacent to the first corner; (b) the second actuator applies pressure to the person's body according to a second trace, wherein the second trace comprises tracing a second segment of the perimeter of the rectangle by moving from a second corner of the rectangle to the midpoint of a second edge that is adjacent the second corner and parallel to the first edge, the first and second corners being diagonal to one another. Three more traces could be applied to the body to complete the perimeter of the rectangle, each actuator applying a pressure from a corner to a mid-point of an edge.

Additionally or alternatively, where the first and second actuators are configured to apply pressure in a series of traces to form a perimeter of a rectangle, the first two traces could comprise the following: (a) the first actuator applies pressure to the person's body according to a first trace, wherein the first trace comprises tracing a first segment of the perimeter of the rectangle by moving from the midpoint of a first edge to a first corner of the rectangle that is adjacent to the first edge; (b) the second actuator applies pressure to the person's body according to a second trace, wherein the second trace comprises tracing a second segment of the perimeter of the rectangle by moving from the midpoint of a second edge to a second corner of the rectangle that is adjacent the second edge, the first and second corners being diagonal to one another. Three more traces could be applied to the body to complete the perimeter of the rectangle, each actuator applying a pressure from a mid-point of an edge to a corner.

As used herein, the term "midpoint" with respect to an edge should be interpreted broadly to include the exact midpoint of the edge length, and any points within the 25-75% region of the edge's length. For example, where an edge is 6 cm, the midpoint could be at the exact midpoint (3 cm) or could be anywhere within the 25-75% region of its length (1.5-4.5 cm) (e.g., within 40-60% (2.4-3.6 cm).

The massaging unit housing the actuators preferably includes an outer surface or contact pad that is suitable for contacting the body of the user (user's skin or clothing). Each actuator could cause the moving pressures to be applied through one or more contact points, each contact point having any suitable area (e.g., between 0 and 100 $cm^2$, between 0.5 and 50 $cm^2$, or between 0.5 and 5 $cm^2$, inclusive). In some preferred embodiments, the contact point could have an area of between 0.5 and 1.0 $cm^2$, inclusive. More preferably, the first and second actuators each apply a pressure via one or more contact points having an area of approximately or exactly 0.75 $cm^2$.

An actuator of the inventive subject matter could apply any suitable pressure to a person's body. First and second actuators of a pair could apply the same or different pressures to the user's body depending on the needs of the user. In some preferred embodiments, the first and second actuators each apply a pressure of between 1 and 10 $kg/m^2$ to the person's body. In some especially preferred embodiments, the pressure applied to the person's body is between 1.5 and 8 kg/m$^2$. The amount of pressure selected to be applied could similarly be selected based on the different needs of the user.

It should be appreciated that the pressure applied by an actuator of the inventive subject matter could be a constant moving pressure, or a vibrating pressure. In some vibrating models, the actuators could be configured to apply pressure to the person's body in a vibrating mode having any suitable frequency. In some preferred embodiments, one or more actuators could be configured to apply a vibrating pressure having a frequency between 100 and 500 cycles per minute to the person's body. In some preferred massage units, the vibrations have a frequency between 200 and 400 cycles per minute.

A rectangle pattern generated by a massage unit could be any suitable size, include any suitable number of traces, and take any suitable length of time to complete. The rectangle's perimeter edges can vary in size based on, for example, person's desired outcome or size. In some preferred aspects, each trace (corner to mid-point or mid-point to corner) will be between 1-20 cm, more preferably between 1-10 cm, and even more preferably between 1-6 cm, inclusive. Viewed from another perspective, the rectangle's edges are preferably between 2-40 cm, more preferably between 2-20 cm, and even more preferably between 2-12 cm, inclusive. In further regard to each trace, the inventor contemplates that each trace be repeated five times per minute. In other words, each actuator applies a pressure that moves at a rate between 0.5 and 1 cm/s and more preferably between 0.083 and 0.5 cm/s. It should also be appreciated that the pattern can comprise a first set, wherein the first and second actuators repeatedly apply pressure to the person's body according to the first and second traces for between 1 and 50 minutes, more preferably between 1 and 20 minutes, and even more preferably between 2.5 and 10 minutes, inclusive, depending on the needs of the user. The massage can further comprise a second set, a third set, and a fourth set that complete the perimeter of the rectangle. The first, second, third and fourth sets could be completed in between 1 and 200 minutes, more preferably between 4 and 80 minutes, inclusive, and even more preferably between 10 and 40 minutes, inclusive.

A preferred pattern further comprises tracing the circumference of a circle or other ellipsoid, and at least one of the first and second actuators could further be configured to apply pressure to the person's body in a pattern that traces the circumference of the circle or other ellipsoid having any suitable circumference. In some preferred embodiments, the circumference of the ellipsoid can be approximately or exactly 12, 18, 25, 31, or 37 cm. As used herein, the term "approximately" means within ±10%. Contemplated massages could include tracing the circle in a counterclockwise direction on the left side of the person's back and tracing the circle in a clockwise direction on the right side of the person's back for 5-20 minutes. Additionally or alternatively, the circle could be traced in a clockwise direction on the left side of the person's back and tracing the circle in a counterclockwise direction on the right side of the person's back for 5-20 minutes. In some preferred massage patterns, pressure is applied to the person's body in a vibration mode having a frequency between 200 and 400 cycles per minute.

It is contemplated that any suitable number of massage units can be incorporated into a massaging system of the inventive subject matter. Preferred systems will include one or more sets of nine units arranged in a linear or 3×3 rectangular configuration. From time to time, each set of nine units is referred to as a "module." The nine units could be separated units comprising nine separated contact pads or outer surfaces. Additionally or alternatively, the nine units could compose a single contact pad or outer surface.

Various devices including one or more modules can be incorporated into various massaging device forms, including for example, a chair, a bed, a hat, a clothing item, a pillow, a sheet or a blanket.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1A:
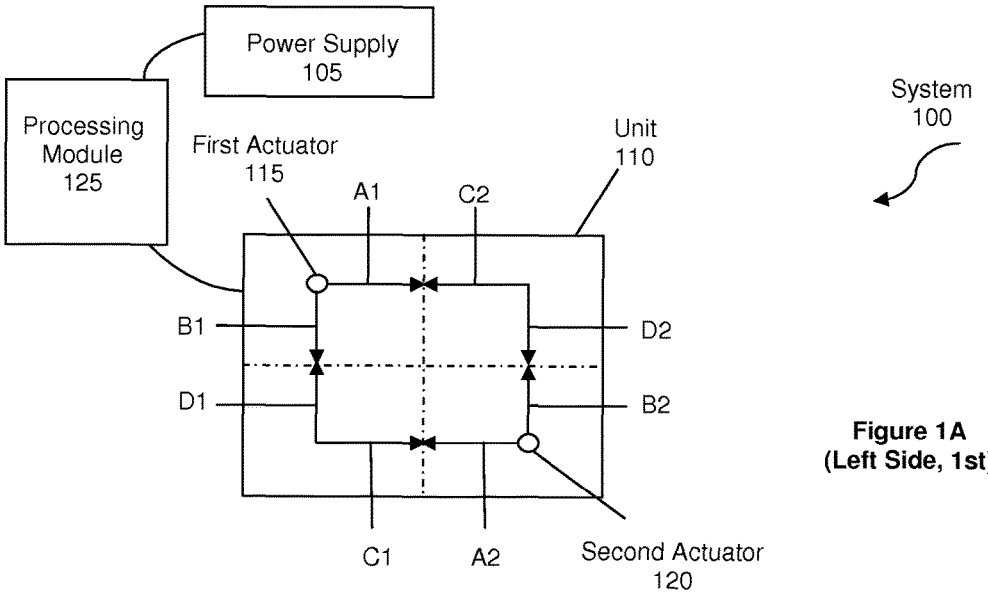
FIG. 1A illustrates a system of the inventive subject matter.

The inventors have unexpectedly discovered that the inventive massaging systems and methods can be used to provide various health benefits including lower blood pressure or glucose levels, or reduced tumor growth or growth rate. As shown in FIG. 1A, massage unit 110 houses first and second actuators, 115 and 120, respectively. Power supply 105 supplies power to processing module 125 and massaging unit 110 to drive the actuators according to a pre-selected pattern. With respect to power supply 105, suitable power supplies convert energy from batteries, fuel cells, generators, solar power converters, or household electrical systems into energy that can be used by processing module 125 and actuators 115 and 120. For example, DC, AC-to-DC, AC, linear regulators, switched-mode, programmable, oruninterruptable power supplies may be employed in contemplated embodiments of the inventive subject matter.

Processing module 125 comprises a memory that stores massage pattern data associated with a plurality of massage paterns, and software instructions that cause the actuators to move according to one or more of the stored patterns.

It should be noted that any language directed to a processing module 125 should be read to include any suitable combination of computing devices, including servers, interfaces, systems, databases, agents, peers, engines, controllers, modules, or other types of computing devices operating individually or collectively. One should appreciate the computing devices comprise a processor configured to execute software instructions stored on a tangible, non-transitory computer readable storage medium (e.g., hard drive, FPGA, PLA, solid state drive, RAM, flash, ROM, etc.). The software instructions preferably configure or program the device to provide the roles, responsibilities, or other functionality as discussed below with respect to the disclosed systems. Further, the disclosed technologies can be embodied as a computer program product that includes a non-transitory computer readable medium storing the software instructions that causes a processor to execute the disclosed steps associated with implementations of computer-based algorithms, processes, methods, or other instructions. In some embodiments, the various servers, systems, databases, or interfaces exchange data using standardized protocols or implementations of algorithms, possibly based on HTTP, HTTPS, AES, public-private key exchanges, web service APIs, known financial transaction protocols, or other electronic information exchanging methods. Data exchanges among devices can be conducted over a packet-switched network, the Internet, LAN, WAN, VPN, or other type of packet switched network; a circuit switched network; cell switched network; PSTN; or other type of network.

As used in the description herein and throughout the claims that follow, when a system, engine, server, device, module, or other computing element is described as configured to perform or execute functions on data in a memory, the meaning of "configured to" or "programmed to" is defined as one or more processors or cores of the computing element being programmed by a set of software instructions stored in the memory of the computing element to execute the set of functions on target data or data objects stored in the memory.

In one embodiment, first actuator 115 is configured to apply a first moving pressure to the person's body in a first direction to create a first trace. The first trace comprises a first segment of a perimeter of a rectangle from a first corner of the rectangle to a midpoint of a first edge that is adjacent to the first corner. Second actuator 120 is configured to apply a second moving pressure to the person's body in a second direction to create a second trace simultaneously with the creation of the first trace by the first actuator. The second trace comprises a second segment of the perimeter of the rectangle from a second corner of the rectangle to a midpoint of a second edge that is adjacent to the second corner, and the first and second edges are parallel.

FIG. 1A shows a first pattern comprising four sets of traces. In the first set, first actuator 115 applies a moving pressure from the top left corner of a rectangle to a midpoint of the top edge of the rectangle along trace A1. At the same time, second actuator 120 applies a moving pressure from the bottom right corner to a midpoint of the bottom edge along trace A2. The term "trace" is used herein to describe the path of movement followed by the actuators. It should be appreciated that the actuator can apply pressure continuously along the trace or in a vibration mode. Suitable pressures can be between 1 and 10 $kg/m^2$ and more preferably between 1.5 and 8 $kg/m^2$. When operating in the vibration mode, the first actuator applies pressure using a tapping motion independent of movement along a trace. The frequency of tapping can be, for example, between 100 and 500 cycles per minute. In some preferred vibration modes, the frequency employed is between 200 and 400 cycles per minute.

In the second set, first actuator 115 applies a moving pressure from the top left corner of the rectangle to the midpoint of the left edge of the rectangle along trace B1. Simultaneous to first actuator 115's propagation along trace B1, second actuator 120 applies a moving pressure from the bottom right corner to the midpoint of the right edge along trace B2.

In the third set, first actuator 115 applies a moving pressure from the bottom left corner of the rectangle to the midpoint of the bottom edge of the rectangle along trace C1. Simultaneously, second actuator 120 applies a moving pressure from the top right corner to the midpoint of the top edge along trace C2.

In the fourth set, first actuator 115 applies a moving pressure from the bottom left corner of the rectangle to the midpoint of the left edge of the rectangle along trace D1. Synchronized with first actuator 115's propagation along trace D1, second actuator 120 applies a moving pressure from the top right corner to the midpoint of the right edge along trace D2.

In some preferred embodiments the rectangle has edges between 1 and 15 cm in length, and in even more preferably between 2 and 12 cm. In some even more preferred embodiments, the rectangle is a square.

With respect to the duration of each set, the inventors contemplate after completing a trace, one or more actuators can "snaps back" to its starting position without applying a pressure to the user. Alternatively, a pressure could be applied in backwards and forward directions along a trace. From the starting position, the application of pressure along the trace can be repeated. Thus the actuators can cycle between applying moving pressure and snapping back for durations ranging from 1 and 20 minutes, and more preferably between 2.5 and 10 minutes per set.

Figure 1B:
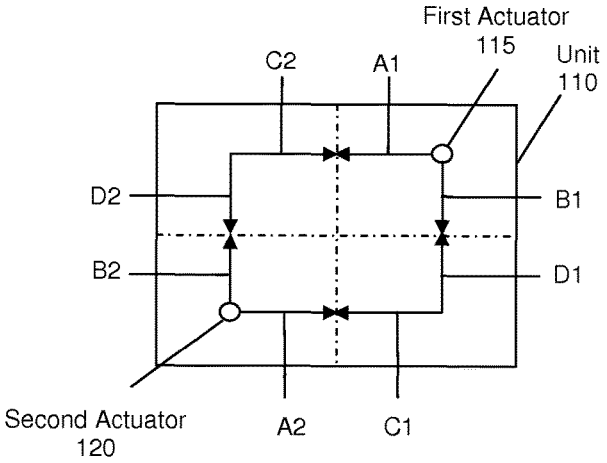
FIGS. 1B-1H illustrate some exemplary massage patterns of the inventive subject matter.

FIG. 1B shows a second pattern in which first actuator 115 applies a moving pressure along trace Al from the top right corner to the midpoint of the top edge. Simultaneously, second actuator 120 applies a moving pressure along trace A2. The first and second actuators continue to apply moving pressures as described above along traces B1, B2, C1, C2, D1, and D2.

Figure 1C:
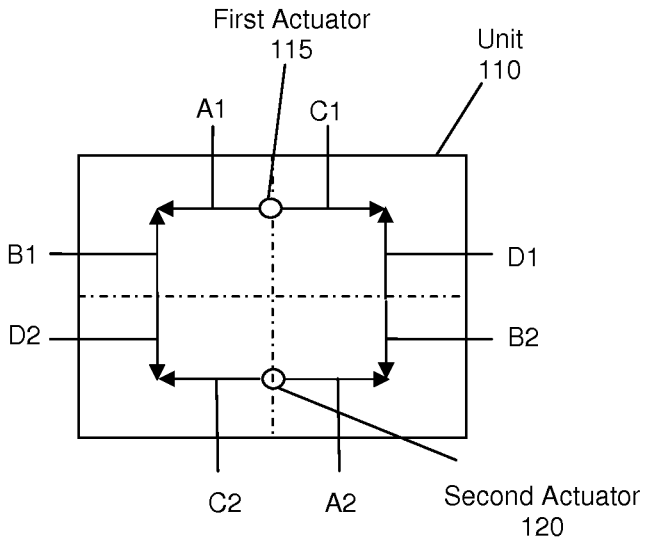

FIG. 1C shows a third pattern. First actuator 115 begins at the midpoint of the top edge of a rectangle and applies a moving pressure along A1 to the top, left corner of the rectangle. Second actuator 120 begins at the midpoint of the bottom edge and applies a moving pressure along A2 to the bottom, right corner of the rectangle in movement synchronized with the movement of first actuator 115. Sequentially, the first and second actuators apply moving pressure along traces B1, B2, C1, C2, D1, and D2 as illustrated in FIG. 1C.

Figure 1D:
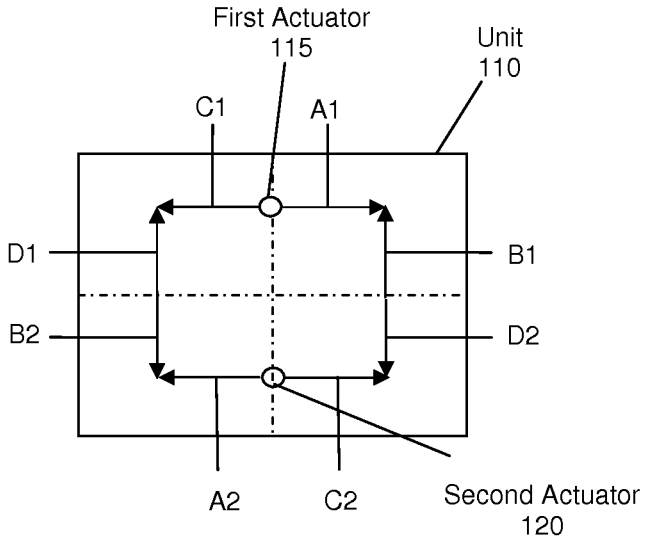

FIG. 1D shows a fourth pattern. In the fourth pattern, first actuator 115 applies moving pressure along traces A1, B1, C1, and D1 sequentially. Here, second actuator 120 moves in the direction opposite to the direction first actuator 115 moves with respect to either a vertical or horizontal axis that bisects the rectangle into substantially equal parts. As used herein with respect to parts of a rectangle, "substantially equal" means the areas of the resulting sub-rectangles are within 10% of each other. Thus, second actuator 120 applies moving pressure along traces A2, B2, C2, and D2.

Figure 1E:
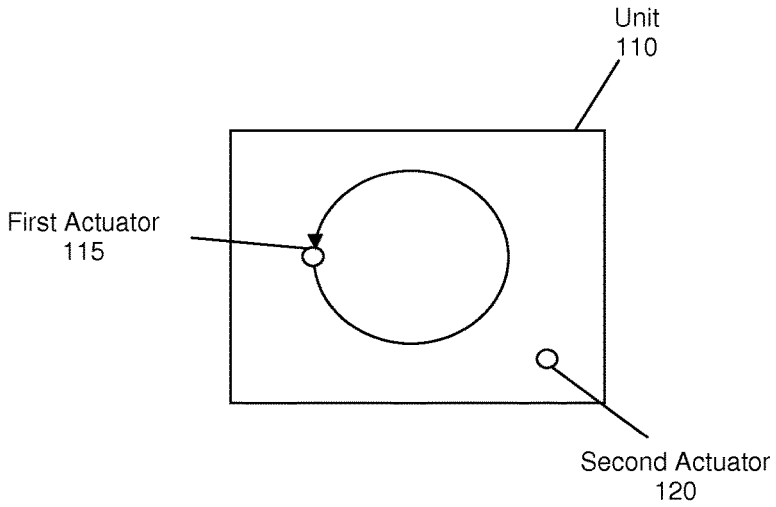
Figure 1F:
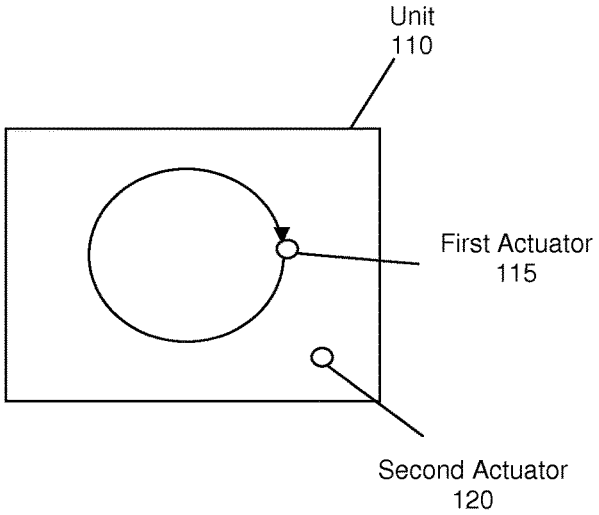
Figure 1G:
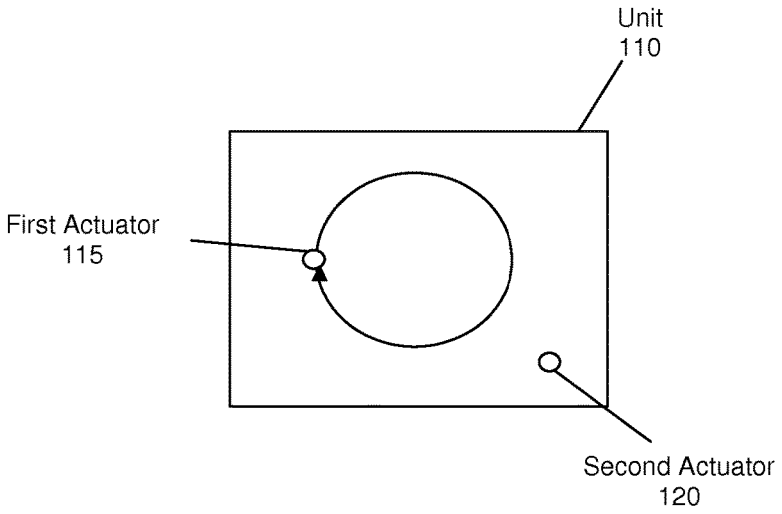
Figure 1H:
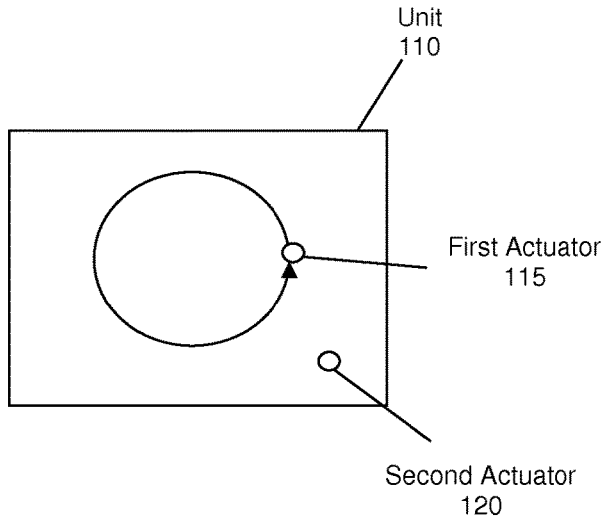

In further aspects of the inventive subject matter first actuator 115 is configured to apply a moving pressure in an elliptical path. It should be appreciated that first actuator 115 can propagate along the elliptical path in the counterclockwise direction (FIG. 1E, FIG. 1H) our clockwise direction (FIG. 1F, FIG. 1G). Second actuator 120 can be configured to stand-by without applying any pressure. Alternatively, second actuator 120 can be configured to apply moving pressure in coordination with first actuator 115. For example, second actuator 120 can apply a moving pressure alongside first actuator 115 or in the opposite direction. In another example, second actuator 120 applies pressure along an ellipsoid path that is concentric with the elliptical path followed by the first actuator. In some preferred embodiments at least one of the minor and major axes has a length of 12, 18, 25, 31, or 37 cm. In some even more preferred embodiments, the elliptical path is circular.

Figure 2A:
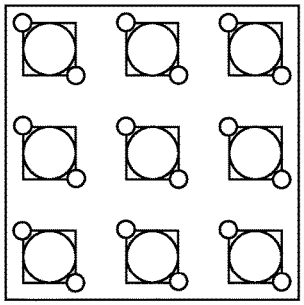
FIGS. 2A-2D illustrate some exemplary massage modules of the inventive subject matter.
Figure 2B:
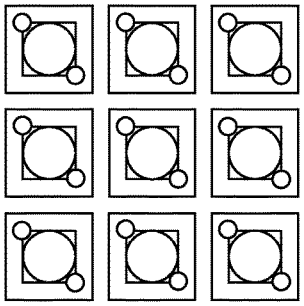
Figure 2C:
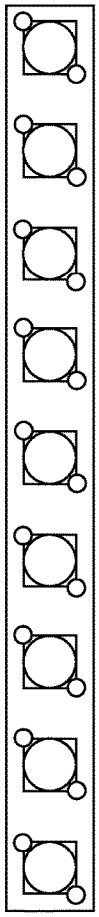
Figure 2D:
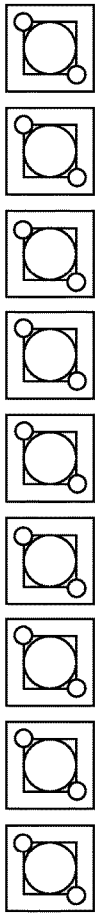

Moreover, the inventors contemplate that pairs of first and second actuators can be arranged in multiple configurations. FIG. 2A shows a massaging unit housing 9 pairs of actuators in a rectangular configuration, comprising three rows of three actuator pairs. Alternatively, FIG. 2B shows a massaging module comprising a rectangular configuration of nine massaging units, each housing a pair of actuators. A linear configuration of nine actuator pairs in one massaging unit is shown in FIG. 2C. FIG. 2D illustrates a linear configuration of nine massaging units in a massaging module. Therefore, it should be apparent that any suitable number of actuator pairs/massaging units can be combined in a massaging device suitable for a person's body dimensions or massage needs.

Figure 3:
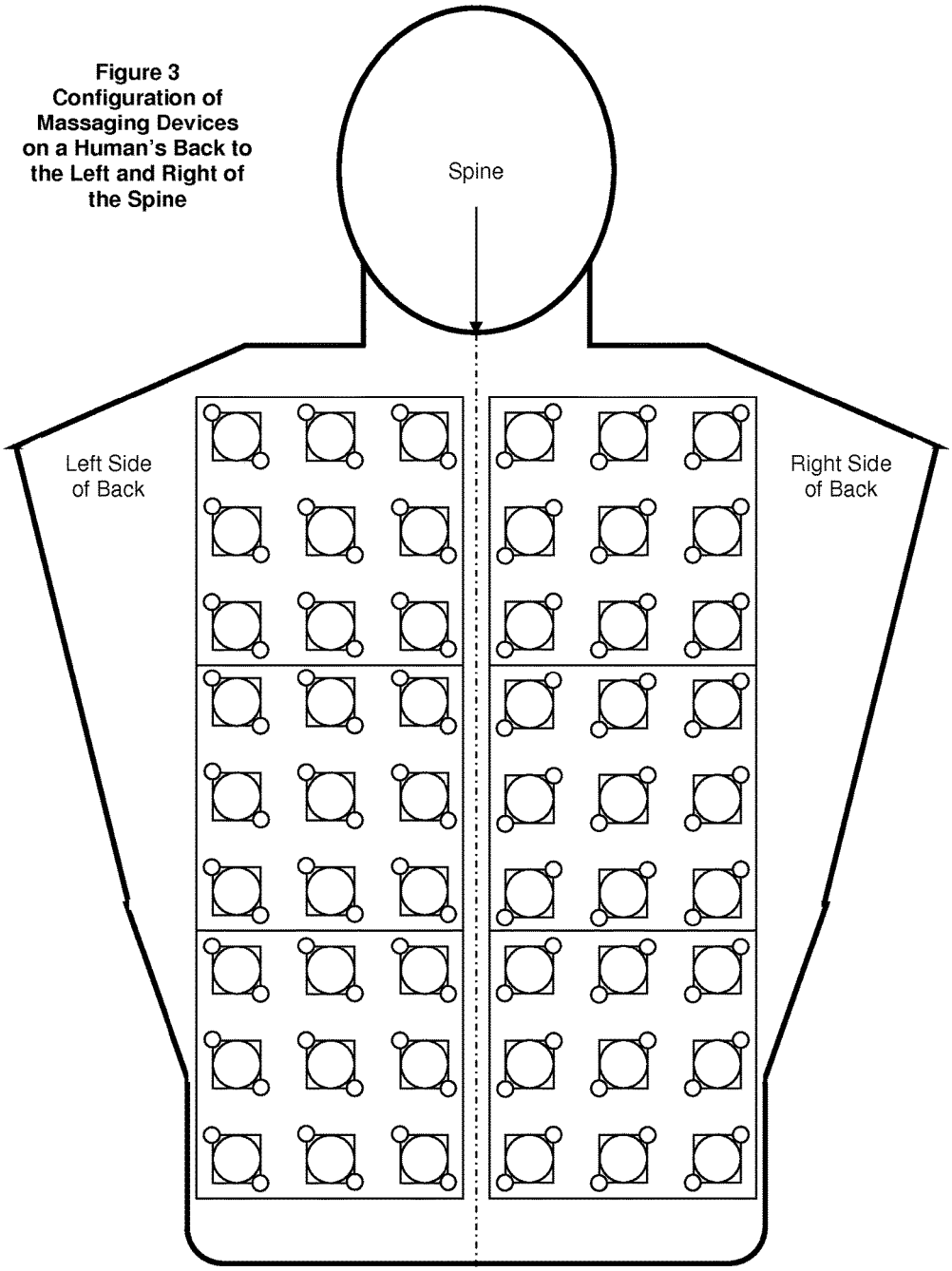
FIG. 3 illustrates the application of massaging modules on the left and right sides of a person's back.

An exemplary configuration of massaging devices is shown in FIG. 3. In FIG. 3, two massaging modules (each having three massage units consistent with the configuration shown in FIG. 2A) are placed on the right and left sides of a person's back. In another example, six linear massage units could be placed on the person's back such that three massage units are applied to each of the right and left sides of the person's back.

In an exemplary method, a massaging device is applied to a person's body, and the massaging device is operated to at least one of reduce tumor growth or growth rate, reduce blood pressure, reduce blood glucose levels, reduce pain, enhance sleep, and enhance the physical fitness of the person. As some non-limiting examples, a person's blood pressure can be reduced from 160/100 (before massage) to 140/70 after one year of use for one hour a day. Blood glucose levels can be reduced by 11-7.8 mmol/L using daily massages for 1 month (1 hour per day) in conjunction with continuing medication. After discontinuing medication, blood glucose levels can be decreased by another 6.4-7 mmol/L after a second month of daily (1 hour) massages. Moreover, the inventor contemplates that tumor cell growth can be stopped, stabilizing tumor size, by two weeks of treatment. After 40 days of treatment, the tumor may gradually disappear. Typically after three months of treatment, the inventor contemplates a 90% reduction in tumor size. It should be appreciated that the results of treatment according to the inventive subject matter depend on each person's situation.

One contemplated method of massaging a person's back employs a sequence of massages in which the spin serves as a mirror plane, and the pattern of massages on the left side is the minor image of the pattern of massages on the right side. The massage device to the left of the person's spine is operated using the first pattern (FIG. 1A), and the device on the right side of the person's back is operated using the second pattern (FIG. 1B). Next, the left massaging device is operated according to the third pattern (FIG. 1C) while the right massaging device is operated using the fourth pattern (FIG. 1D). Preferably, the massaging devices are operated in each pattern for between 2.5 and 10 minutes. After the first two patterns are complete, the left massaging device is operated in the pattern shown in FIG. 1E, and the right massaging device is operated in the pattern shown in FIG. 1F for 5-20 minutes. Lastly, the left and right massaging devices are operated for 5-20 minutes in the patterns shown in FIGS. 1G and 1H, respectively. In even more preferred methods, the massaging devices are operated in a vibration mode having a frequency between 200 and 400 cycles per minute. It should be appreciated that the duration of each pattern and the dimensions of the rectangles and ellipses can be customized to the person's massage needs and physical proportions.

While the disclosure herein is generally directed to massage patterns that are rectangular or ellipsoid, it should be appreciated that massaging units of the inventive subject matter could be programmed or configured to generate any suitable massage patterns. Additionally, it should be appreciated that the rectangles, ellipsoids, and other patterns generated could be complete patterns (e.g., a closed rectangle with all edges touching two corners), or partial patterns (e.g., an incomplete ellipsoid where the start point and end point of a trace does not touch).

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as", etc.) provided with respect to certain embodiments herein is intended merely to better illuminate the invention and does not pose a limitation on the scope of the invention otherwise claimed. No language in the specification should be construed as indicating any non-claimed element essential to the practice of the invention.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

What is claimed is:

1. A massage system for a person's body, comprising:

a first massaging unit coupled to an processing module and a power supply;

a first actuator housed in the first massaging unit and configured to apply a first moving pressure to the person's body in a first direction to create a first trace;

a second actuator housed in the first massaging unit and configured to apply a second moving pressure to the person's body in a second direction to create a second trace simultaneously with creation of the first trace by the first actuator;

wherein the first trace comprises a first segment of a perimeter of a rectangle from a first corner of the rectangle to a midpoint of a first edge that is adjacent to the first corner;

wherein the second trace comprises a second segment of the perimeter of the rectangle from a second corner of the rectangle to a midpoint of a second edge that is adjacent to the second corner; and wherein the first and second edges are parallel.

2. The massage system of claim 1, wherein the first actuator is further configured to snap back to the first corner of the rectangle and reapply the first moving pressure to the person's body in the first direction to recreate the first trace.

3. The massage system of claim 1, wherein the first actuator has one or more contact points having an area between0.5 $cm^2$ and 1.0 $cm^2$, inclusive.

4. The massage system of claim 1, wherein the first actuator has one or more contact points having an area of 0.75 $cm^2$, inclusive.

5. The massage system of claim 1, wherein the first actuator applies a pressure of between 1 $kg/m^2$ and 10 $kg/m^2$ to the person's body, inclusive.

6. The massage system of claim 1, wherein the first actuator applies a pressure of between 1.5 $kg/m^2$ and 8 $kg/m^2$ to the person's body, inclusive.

7. The massage system of claim 1, wherein the first actuator applies pressure in a vibrating mode having a frequency between 100 cycles and 500 cycles per minute to the person's body, inclusive.

8. The massage system of claim 1, wherein the first actuator applies a pressure in a vibrating mode having a frequency between 200 cycles and 400 cycles per minute to the person's body, inclusive.

9. The massage system of claim 1, wherein the first edge is between 1 cm and 15 cm, inclusive.

10. The massage system of claim 1, wherein the first edge is between 2 cm and 12 cm, inclusive.

11. The massage system of claim 1, wherein the first and second actuators are further configured to apply the first and second moving pressures to the person's body in a first set, wherein the first set comprises repeatedly applying the first and second moving pressures to the person's body according to the first and second traces for between 1 minute and 20 minutes, inclusive.

12. The massage system of claim 1, wherein the first and second actuators are further configured to apply the first and second moving pressures to the person's body in a first set, wherein the first set comprises repeatedly applying the first and second moving pressures to the person's body in the first and second directions, respectively, for between 2.5 minutes and 10 minutes, inclusive.

13. The massage system of claim 1, wherein the first actuator is further configured to apply a third moving pressure to the person's body in a third direction to create a third trace, wherein the first actuator is further configured to apply a fourth moving pressure to the person's body in a fourth direction to create a fourth trace, wherein the third trace comprises a third segment of the perimeter of the rectangle from the midpoint of the first edge of the rectangle to the first corner; and wherein the fourth trace comprises a fourth segment of the perimeter of the rectangle from the midpoint of the second edge to the second corner.

14. The massage system of claim 13, wherein the first and second actuators are further configured to apply the pressure to the person's body according to a second set, wherein the second set comprises repeatedly applying the third and fourth moving pressures to the person's body in the third and fourth directions, respectively, for between 2.5 minutes -and 10 minutes, inclusive.

15. The massage system of claim 1, wherein the first actuator is further configured to apply a fifth moving pressure to the person's body in a clockwise direction to create a fifth trace.

16. The massage system of claim 1, wherein the first actuator is further configured to apply a sixth moving pressure to the person's body in a counter-clockwise direction to create a sixth trace.

17. The massage system of claim 1, wherein the first massaging unit further comprises eight additional pairs of actuators, and wherein the first and second actuators and the eight additional pairs of actuators are arranged in at least one of a rectangular and a linear pattern.

18. The massage system of claim 1 further comprising second, third, fourth, fifth, sixth, seventh, eight, and ninth massaging units, each having two actuators.

19. A method of massaging a person's body, comprising:

applying a massage unit including first and second actuators on the person's body;

simultaneously causing the first actuator to apply a first moving pressure to the person's body in a first direction from a first start position to a first end position to create a first trace, and the second actuator to apply a second moving pressure to the person's body in a second direction from a second start position to create a second trace;

wherein the first start position comprises a first corner of a rectangle, the first end position comprises a midpoint of a first edge of a rectangle that is adjacent the first corner, the second start position comprises a second corner of the rectangle, the second end position comprises a midpoint of a second edge of the rectangle that is adjacent the second corner, and wherein the first and second edges are parallel; and simultaneously causing the first and second actuators to snap back from the first and second end positions, respectively, to the first and second start positions, respectively.

20. The method of claim 19, wherein the step of applying the applying the massage unit comprises laying the massaging unit on a left or right side of a spine of the person's body.

* * * * *